US006585314B2

(12) United States Patent
Richardson

(10) Patent No.: US 6,585,314 B2
(45) Date of Patent: Jul. 1, 2003

(54) TABLET ARM ATTACHMENT FOR FOLDING CHAIR HAVING GANGING FEATURE

(75) Inventor: James Michael Richardson, West Springfield, MA (US)

(73) Assignee: Columbia Manufacturing, Inc., Westfield, MA (US)

( * ) Notice: Subject to any disclaimer, the term of this patent is extended or adjusted under 35 U.S.C. 154(b) by 0 days.

(21) Appl. No.: 09/927,627

(22) Filed: Aug. 10, 2001

(65) Prior Publication Data

US 2003/0030307 A1 Feb. 13, 2003

(51) Int. Cl.[7] ..... A47B 39/06; A47B 83/02
(52) U.S. Cl. ..... 297/162; 297/160; 297/248
(58) Field of Search ..... 297/162, 160, 297/248

(56) References Cited

U.S. PATENT DOCUMENTS

| | | | | | |
|---|---|---|---|---|---|
| 1,864,750 | A | * | 6/1932 | Moore | 297/162 |
| 2,650,651 | A | | 9/1953 | Choate | 297/160 X |
| 2,664,943 | A | * | 1/1954 | Clarin | 297/162 |
| 2,954,073 | A | * | 9/1960 | Junkunc | 297/162 |
| 3,024,065 | A | | 3/1962 | Eves et al. | 297/162 |
| 3,099,479 | A | | 7/1963 | Banke | 297/162 X |
| 3,127,218 | A | | 3/1964 | Banke | 297/248 |
| 3,174,795 | A | | 3/1965 | Chapman et al. | 297/248 X |
| 3,194,600 | A | | 7/1965 | Junkunc | 297/248 X |
| 3,197,253 | A | * | 7/1965 | Brown | 297/162 |
| 3,206,249 | A | | 9/1965 | Gateley | |
| 3,227,487 | A | * | 1/1966 | Blanchard, Jr. et al. | 297/248 |
| 3,233,939 | A | | 2/1966 | Chapman | 297/162 |
| 3,259,429 | A | | 7/1966 | Banke | |
| 3,261,641 | A | * | 7/1966 | Black et al. | 297/162 |
| 3,265,436 | A | | 8/1966 | Bombard et al. | 297/162 |
| 3,267,887 | A | | 8/1966 | Boyd | 297/160 X |
| 3,292,972 | A | | 12/1966 | Krueger | 297/162 |
| 3,368,842 | A | | 2/1968 | Polsky | 297/162 |
| 3,375,038 | A | | 3/1968 | Krueger | 297/160 |
| 3,547,488 | A | | 12/1970 | Barnes | 297/162 |
| 3,556,588 | A | | 1/1971 | Monyer et al. | 297/162 |
| 3,614,157 | A | * | 10/1971 | Hendrickson et al. | 297/248 |
| 3,784,249 | A | * | 1/1974 | Hendrickson et al. | 297/162 |
| 5,451,092 | A | | 9/1995 | Gray | 297/162 X |
| 5,454,581 | A | | 10/1995 | Ringer | 297/162 X |
| 5,683,136 | A | | 11/1997 | Baumann et al. | 297/162 |
| 5,863,096 | A | * | 1/1999 | Bartlmae | 297/248 |
| 6,012,773 | A | | 1/2000 | Best | 297/162 X |
| 6,073,997 | A | | 6/2000 | Koh | 297/162 X |
| 2002/0105214 | A1 | * | 8/2002 | Richardson | 297/248 |

* cited by examiner

*Primary Examiner*—Peter M. Cuomo
*Assistant Examiner*—Rodney B. White
(74) *Attorney, Agent, or Firm*—McCormick, Paulding & Huber LLP

(57) ABSTRACT

A folding tablet arm attachment mounted on a metal folding chair which has a ganging feature includes an elongated rectilinear tubular attachment member which has longitudinally spaced apart female keyhole openings formed in a sidewall thereof and internally reinforced for mating coupling engagement with male ganging studs mounted in cantilever position on a rectilinear siderail of the chair whereby the folding tablet arm attachment is positioned and supported on the chair. Fastening tabs carried by the attaching member and disposed in overlying engagement with the chair siderail are fastened to the siderail and releasably secure the tablet arm attachment to the chair to provide a firm working or writing surface for a person seated on the chair.

19 Claims, 5 Drawing Sheets

TABLET ARM ATTACHMENT FOR FOLDING CHAIR HAVING GANGING FEATURE

FIELD OF INVENTION

This invention relates in general to chairs and seats and deals more particularly with a folding tablet arm attachment for a folding chair having a ganging feature.

BACKGROUND OF THE INVENTION

Folding chairs of the type with which the present invention is concerned are often employed in auditoriums, gymnasiums, school classrooms and other places of assembly where temporary row seating or flexibility of seating arrangement is desired. When a relatively large number of people must be accommodated it may be necessary to couple together or gang chairs to form rows of connected chairs in compliance with fire codes. However, in situations where fewer persons are to be seated, individual placement of chairs in spaced apart relation to each other may be permissible. In such situations it is often desirable to provide each person with a working or writing surface, as, for example, where the chairs are set up in a lecture hall and those in attendance may wish to take notes, or where the chairs are to be used in a school classroom in the administration of a test or examination and the provision of a writing surface is essential.

Accordingly, it is the general aim of the present invention to provide an improved tablet arm attachment for a folding chair having a ganging feature to increase the versatility of the chair and enable the chair to be readily adapted to satisfy diverse seating requirements. It is a further aim of the present invention to provide an improved folding tablet arm attachment for a folding chair having a ganging feature and which enables the tablet arm attachment to be secured to and removed from the chair with minimal required labor.

SUMMARY OF THE INVENTION

In accordance with the present invention, a tablet arm attachment is provided for a folding chair having a chair frame including a pair of elongated side members and ganging means, including male and female ganging elements associated with the side members for coupling engagement with other ganging elements on chairs of like kind. The tablet arm attachment comprises a tablet arm having a substantially planar working or writing surface, an elongated attaching member, supporting means for mounting the tablet arm on the attaching member, and releasable attaching means for positioning and supporting the tablet arm attachment on an associated one of the side members and including a male ganging element carried by one of the members which comprise the attaching member and the associated one of the side members and a female ganging element carried by the other of the members which comprise the attaching member and the associated one of the side members.

DETAILED DESCRIPTION OF PREFERRED EMBODIMENT

Figure 1:
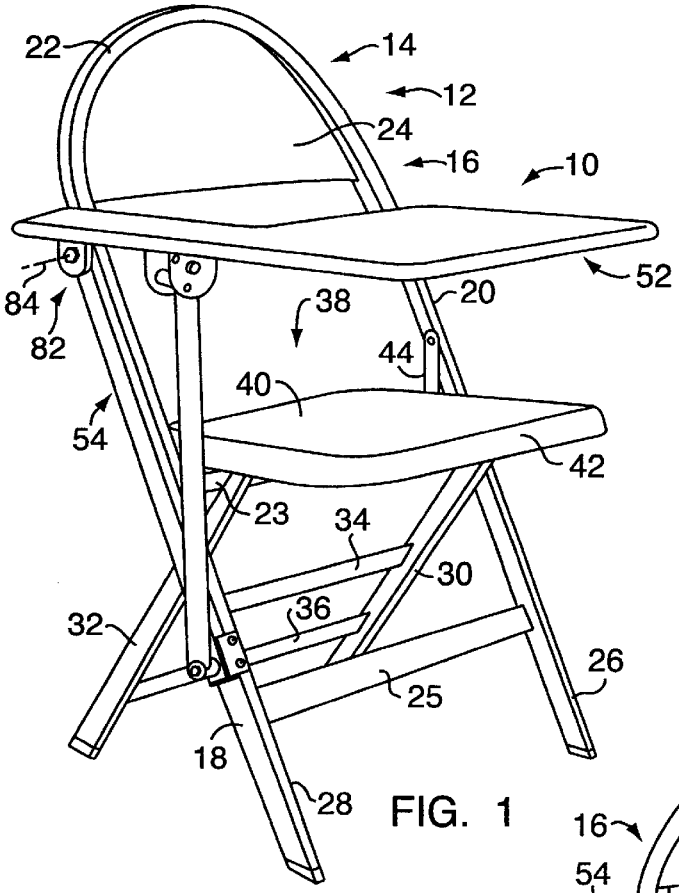
FIG. 1 is a perspective view of a folding tablet arm attachment mounted on a folding chair and shown in working position.

A tablet arm attachment embodying the present invention is specifically adapted for use in combination with a folding chair having a ganging device which includes male and female ganging elements. The ganging elements are integrally associated with the chair frame and may be used to couple the chair in adjacent in-line relation to other chairs of like kind to form a row of connected chairs in compliance with applicable fire codes. Alternatively, and in accordance with the invention, the ganging device associated with the chair may be utilized to position and support a folding tablet arm attachment on the chair whereby the tablet arm may be further secured to the chair and supported in an operative or working position and, if desired, arranged for movement between the working position and a collapsed or storage position relative to the chair, as will be hereinafter more fully discussed.

In the drawings and in the description which follows, a folding tablet arm attachment embodying the present invention and indicated generally at 10 is shown in combination with a metal folding chair of the type herein before generally described. The illustrated chair, indicated generally by the reference numeral 12, is a Model No. 2237 Black Diamond folding chair manufactured and marketed by Columbia Manufacturing Inc., One Cycle Street, Westfield, Mass. 01085, assignee of the present invention.

Figure 2:
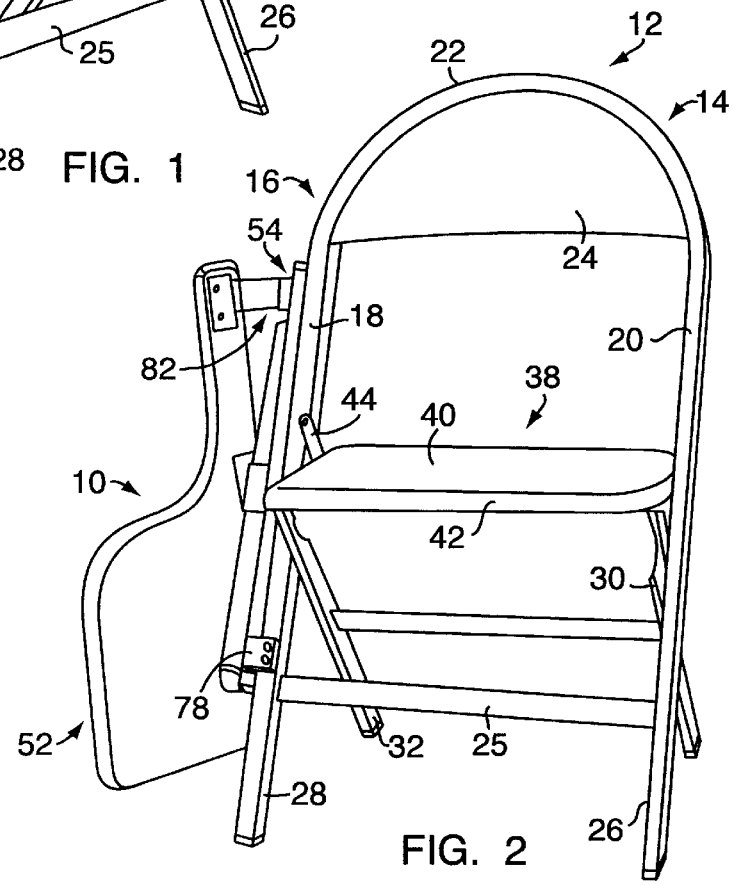
FIG. 2 is a perspective view of the tablet arm attachment and chair of FIG. 1, shown with the tablet arm in storage position.

Before further considering the folding tablet arm attachment 10, and to provide background for a clear understanding of the invention, the chair 12 will be briefly described. Referring first particularly to FIGS. 1 and 2, the chair 12 has a frame indicated generally by the reference numeral 14 and substantially formed from tubular metal of generally rectangular cross-section. The frame 14 includes a main frame member indicated generally at 16, which defines a pair of axially elongated generally rectilinear side members 18 and 20. The upper ends of the side member 18 and 20 are integrally connected by an arcuate transverse by extending connecting member 22. The side members 18 and 20 cooperate with the connecting member 22 to support an anatomically contoured backrest 24 at the upper end of the main frame member 16. When the folding chair 12 is in its setup position, as it appears in FIGS. 1 and 2, the main frame member 16 is upwardly and rearwardly inclined so that the lower part of the main frame member defines a pair of front legs, which, as viewed in the drawings, include a right front leg 26 and a left front leg 28. The right and left front legs 26 and 28 are connected to each other by horizontally extending upper and lower transverse cross members 23 and 25. The frame 14 also has a rear leg assembly which includes a right rear leg 30 and a left rear leg 32. The right and left rear legs 30 and 32 are connected by horizontally disposed transverse by extending cross members 34 and 36, substantially as shown. The right and left rear legs 30 and 32 are mounted inwardly adjacently the respectively associated right and left front legs 26 and 28 and are pivotally connected in crossing relation to the front legs at crossing points by headed pivot pins or rivets (not shown).

The illustrated chair 12 has a formed metal seat, indicated generally at 38, which, as shown in the drawings, defines an upwardly facing anatomically contoured seating surface 40 surrounded by a depending annular peripheral flange 42. The upper ends of the rear legs 30 and 32 are respectively pivotally connected to the peripheral flange 42 at opposite sides of the seat proximate the forward end of the seat 38. The rear end portion of the seat 38 is pivotally connected to the side members 18 and 20 by a pair of connecting links 44, 44. When the chair is in its setup position, as it appears in FIGS. 1 and 2, the rear portion of the seat 38 rests upon the upper cross member 23. Depending tabs carried by the links 44, 44, but not shown, cooperate in engagement with the upper cross member 23 to limit forward movement of the seat 38 relative to the main frame 14 and maintain the chair 12 in its seating or setup position, in a manner well known in the folding chair art.

The ganging or coupling device for releasably connecting the chair 12 in side-by-side relation to other chairs of like kind to form a uniform row or ganged arrangement of connected chairs includes two pair of connecting or ganging elements. Each pair of gange elements includes a female ganging or connecting element mounted on an associated one of the chair side members 18 and 20 and a male ganging or connecting element mounted on the other or opposite one of the side members. However, in accordance with presently preferred chair construction, two male connecting elements are carried by the left side member 18 and two female connecting elements are associated with the right side member 20. Each male connecting element comprises an axially elongated headed stud indicated generally at 46 and in FIG. 3 of the drawings there is shown a somewhat enlarged fragmentary portion of the left side member 18 with studs 46, 46 attached thereto. Each stud 46 has a generally cylindrical body 48 and a diametrically enlarged head 50 at its outer or free end. The studs may be connected to the chair frame in various ways and project axially outward from an associated one of the side members in axially normal cantilever position relative to the associated side member. In the illustrated embodiment 12, both studs 46, 46 are mounted in longitudinally spaced apart relation to each other on the longitudinally elongated left side member 18.

Figure 17:
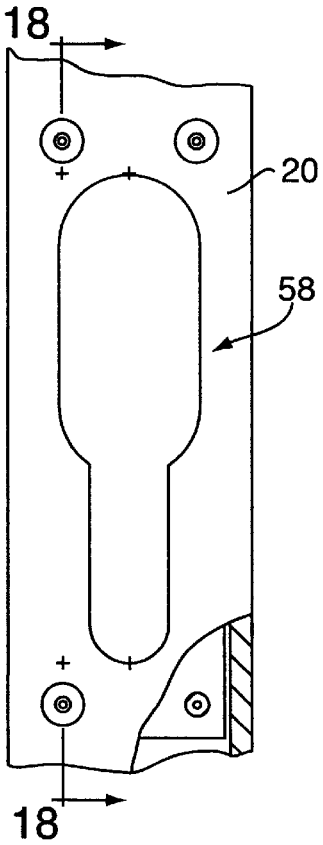
FIG. 17 is a somewhat enlarged fragmentary right side elevational view of the right side member of the chair of FIGS. 1 and 2 and shows a typical female ganging element.
Figure 18:
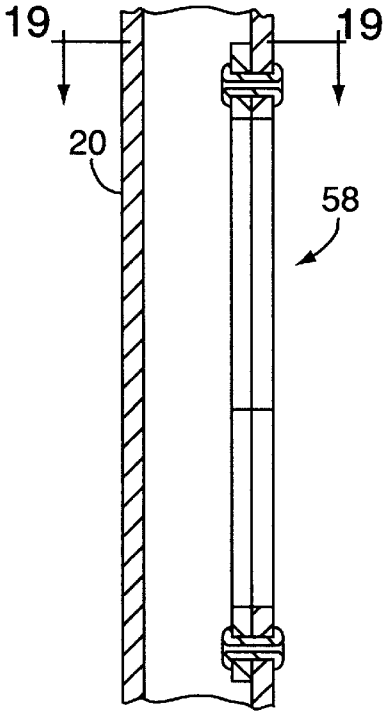
FIG. 18 is a fragmentary sectional view taken along the line 18—18 of FIG. 17.
Figure 19:
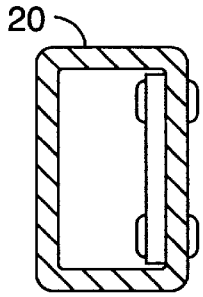
FIG. 19 is a fragmentary sectional view taken along the line 19—19 of FIG. 18.
Figure 20:
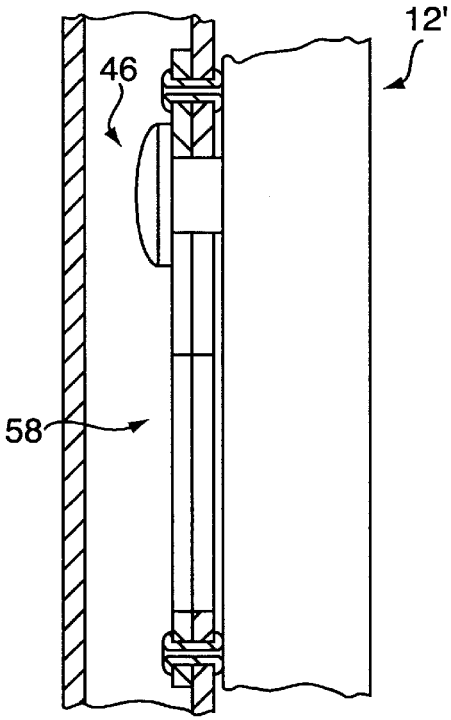
FIG. 20 is a fragmentary sectional view showing a typical ganging connection between two folding chairs of like kind.

The female ganging or connecting elements on the chair 12 preferably comprise keyslots indicated generally at 58, defined at least in part by the tubular side member 20 and located in a longitudinally spaced apart relation to each other at the right hand side of the chair 12 as shown in FIGS. 17 and 18 (one shown). The female ganging elements 58 are adapted to receive and mate with male ganging elements 46 on the left side member 18 of another chair 12' similar to the chair 12, whereby the two chairs may be releasably retained in adjacent in-line coupled relation to each other, as shown in 20, when the chairs are ganged or coupled together to form an in-line row.

In accordance with the present invention, the ganging feature on the folding chair 12, may also be utilized to position and support the tablet arm attachment 10 on the chair when the ganging feature is not being employed to perform its usual chair ganging function.

Figure 4:
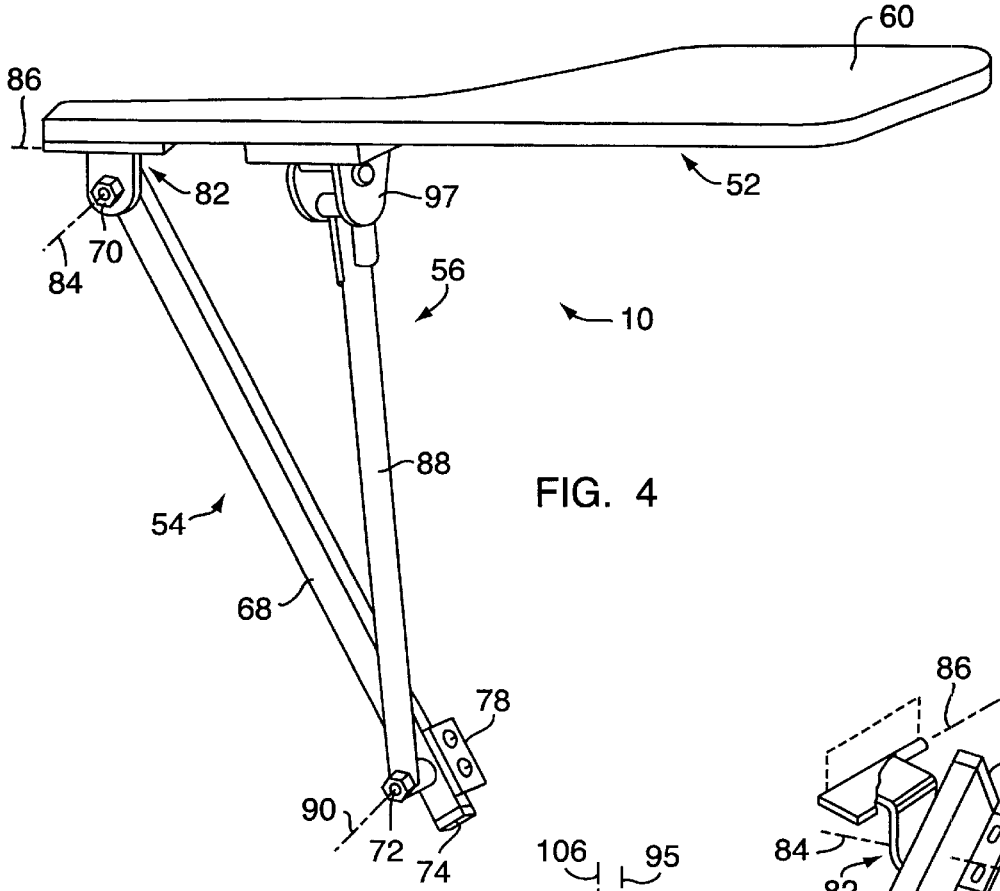
FIG. 4 is a somewhat enlarged perspective view of the folding tablet arm attachment of FIGS. 1 and 2.
Figure 5:
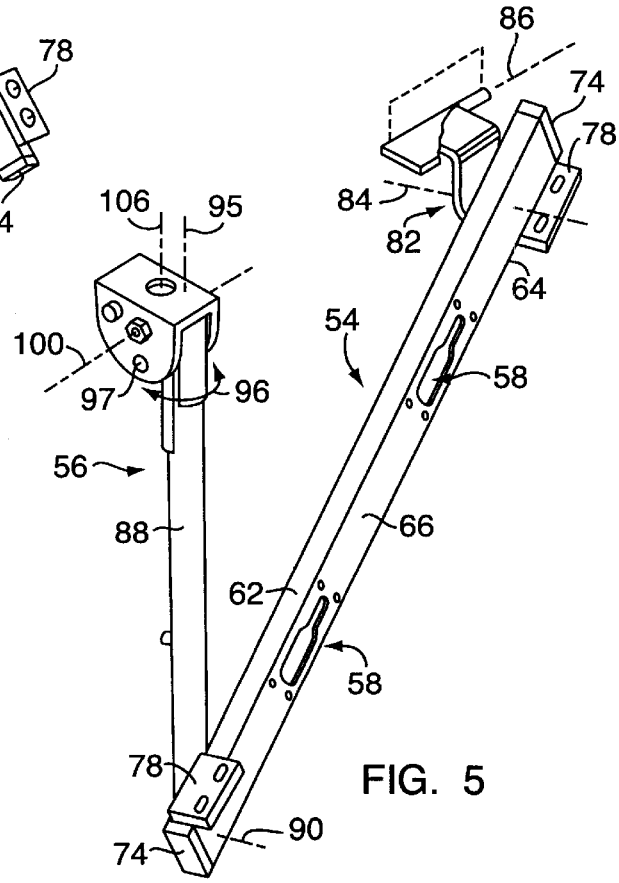
FIG. 5 is a perspective view of the tablet arm supporting and attaching structure.
Figure 6:
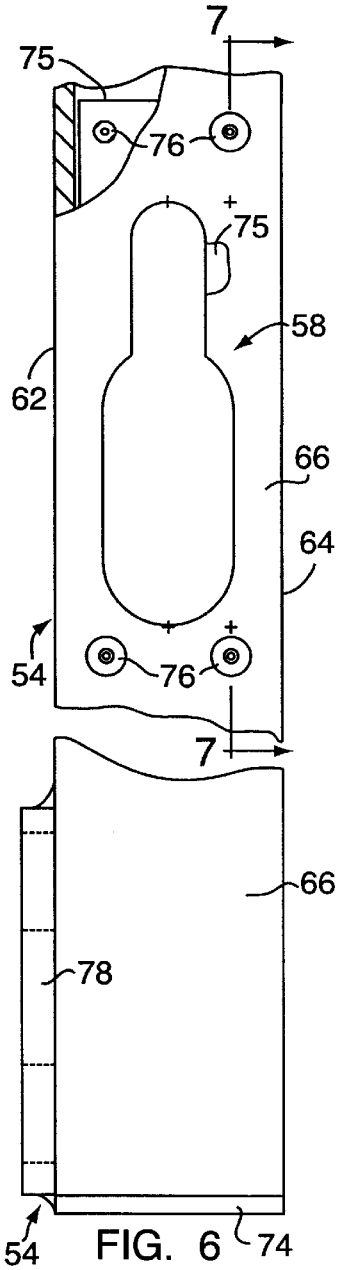
FIG. 6 is a somewhat enlarged fragmentary side elevational view of the tablet arm attaching member.
Figure 7:
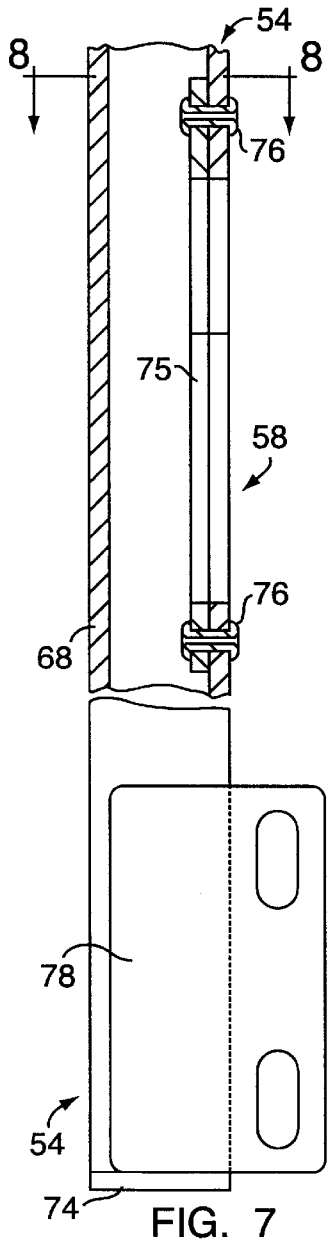
FIG. 7 is a fragmentary sectional view taken along the line 7—7 of FIG. 6.

Referring particularly to FIGS. 4–5, the presently preferred tablet arm attachment 10 may best be characterized as a foldable or collapsible tablet arm attachment and essentially comprises a tablet arm indicated generally at 52, an attaching member indicated generally at 54, a tablet arm supporting structure designated generally by the numeral 56 for mounting the tablet arm 52 on the attaching member 54, and releasable attaching means 58, 58 for positioning and supporting the attaching member on the folding chair 10 in adjacent parallel relation to an associated one of the side members 18 and 20 to support the tablet arm attachment 10 on the chair 12 with the tablet arm 52 accurately located in a predetermined position relative to the chair.

Further considering the tablet arm attachment 10, the tablet arm 52 may be made from a suitable material and may take various forms, but preferably it comprises a panel formed, at least in part, from a melamine resin compound and includes a generally rectangular tablet portion and a relatively narrow arm rest portion which extends rearward from the tablet portion and along one side of the tablet arm 52. The tablet arm 52 defines a substantially planar working surface indicated at 60 which faces in an upward direction when the tablet arm is its usable or working position, as it appears in FIG. 1.

The attaching member 54 comprises an axially elongated generally rectilinear tube preferably formed from tubular metal substantially similar, if not identical, to the tubular metal from which the chair main frame member 16 is made. The attaching tube 54 has a substantially uniform generally rectangular cross section throughout its entire length defined by a front wall 62, a rear wall 64, and opposing inner and outer sidewalls indicated 66 and 68, respectively, and best shown in FIGS. 6–9. A pair of mounting studs 70 and 72, best shown in FIG. 4, have threaded outer ends and are mounted in cantilever position proximate the upper and lower ends of the attaching member 54 and project laterally outwardly in axially normal relation to the outer surface of the outer sidewall 68. Plastic end caps 74, 74 provide closures for opposites ends of the tubular member 54.

Figure 3:
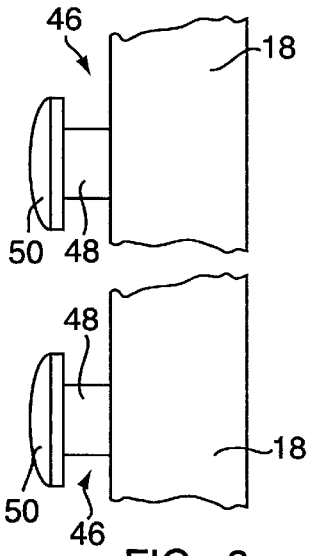
FIG. 3 is a somewhat enlarged fragmentary front elevational view of a chair frame side member with male ganging elements thereon.

The illustrated tablet arm attachment 10 is shown in FIG. 1 supported in a working position the chair left hand side member 18 to accommodate a seated right-handed person. Since the side member 18 carries two male ganging element 46, 46, as shown in FIG. 3, the attaching member 54 which, is adapted to be supported on the side member 18, must have two female ganging elements adapted for releasable connection with the male elements 46, 46.

In FIGS. 6–9 there is shown a typical female ganging element 58 for coupling engagement with an associated male element 46. The illustrated female ganging element 58 comprises a keyslot 58 defined by an internally reinforced portion of the tubular attaching member 54. More specifically, the illustrated female ganging element or keyslot 58 is defined at least in part by the inner sidewall 66, and preferably further defined by a generally rectangular reinforcing plate 75 disposed within the tubular member 54 and mounted in fixed position adjacent an inner surface of the inner sidewall 66 by a plurality of fasteners or rivets 76, 76. The keyslot 58 communicates with the interior of the attaching member 54 and comprises an elongated slot which extends longitudinally of the attaching member 54. The upper end portion of the keyslot 58 has a width dimension at least equal to the diameter of the male ganging stud cylindrical body 48, which is adapted to be received within the upper portion of the slot. Another portion of the longitudinally extending keyslot 58 has a transversely enlarged width dimension sized to allow the enlarged head 50 on an associated male ganging element 46 to pass freely therethrough. The longitudinal spacing between the two female ganging elements or keyslots 58, 58 defined by the attaching member 54 is substantially equal to the center distance between the two male ganging elements 46, 46 carried by the chair side member 18. Thus, the male and female ganging elements 46, 46 and 58, 58 may be releasably coupled to position and support the attaching member 54 in a predetermined position on the chair frame with the attaching member 54 in substantial parallel alignment with the associated chair frame side member 18 upon which it is supported, whereby the tablet arm attachment 10 is properly positioned and supported on the chair 12.

It should be noted that some slight clearance should be provided between the male and female ganging elements for ease of assembly. This clearance or tolerance is particularly desirable where a number of tablet arm attachments and chairs must be coupled or uncoupled to alter a seating arrangement within a room. Such assembly tolerance is further desirable so that any one of a group of tablet arm attachments 10, 10 may be coupled to any chair in a group of associated chairs 12, 12. However, the provision of such assembly tolerance may and often will result in some undesirable play or relative movement between a tablet arm attachment and an associated chair to which it is attached. In accordance with the present invention, the aforementioned problem is overcome by the provision of at least one fastening tab 78 mounted in fixed position on the attaching member 54 and releasably secured by fasteners to an associated one of the chair side members upon which the attaching member is supported.

In accordance with presently preferred practice the illustrated attaching member 54 has two fastening tabs 78, 78 welded thereto or otherwise mounted in fixed position thereon. The fastening tabs 78, 78 are preferably mounted proximate opposite ends and at opposite sides of the attaching member 54 as best shown in FIG. 5 where the lower fastening tab is shown mounted on the attaching member front wall 62 and the upper fastening tab 78 is shown mounted on the attaching member rear wall 64.

Figure 9:
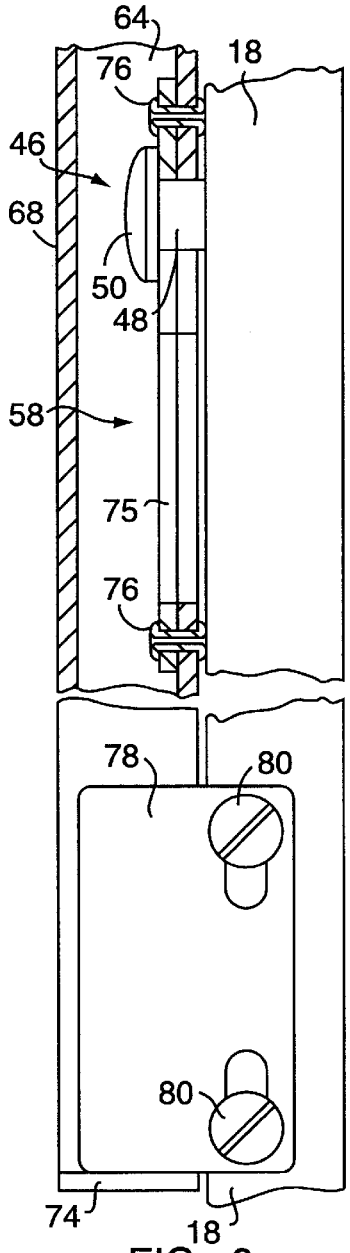
FIG. 9 is a fragmentary front elevational view and shows the attaching member in longitudinal axial section and connected to and associated one of the chair frame side members.
Figure 8:
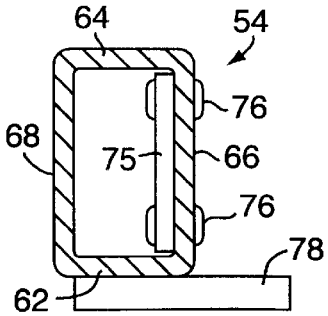
FIG. 8 is a sectional view taken along the line 8—8 of FIG. 7.

A typical fastening tab 78 is shown mounted proximate the lower end of the attaching member 54 in FIGS. 6–9. The fastening tab 78 preferably comprises a generally rectangular metal plate welded or otherwise suitably secured in fixed position to the attaching member front wall 62. The tab 78 projects laterally inward and beyond the inner surface of the inner sidewall 66 and overlies an associated portion of the frontal surface of the associated chair side member 18, as best shown in FIG. 9. The tab 78 projects beyond the outer surface of the inner sidewall 66 a sufficient distance to substantially overlie the entire width of the associated side member 18 to which it is secured. Preferably, and as shown, each slotted fastening tab 78 is releasably secured to the chair frame side member 18 by a plurality of threaded fasteners indicated at 80, 80. Thus, a firm and positive connection is established between the attaching member 54 and the associated chair siderail 18 upon which the attaching member is supported. This fastening arrangement overcomes any tendency for the occurrence of relative movement or play between the tablet arm attachment 10 and the chair 12 upon which it is supported, so that the tablet arm in its working position provides a firm well supported working or writing surface 60 for a person seated in the chair 12.

Figure 10:
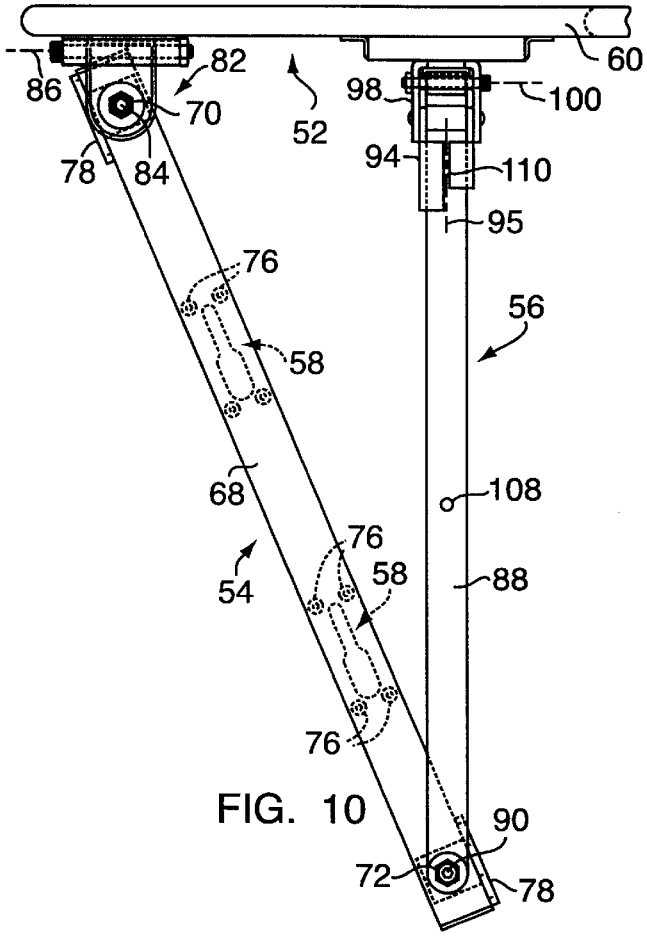
FIG. 10 is a somewhat enlarged fragmentary side elevational view of the tablet arm attachment shown in FIG. 4.

The tablet arm supporting structure for mounting a tablet arm on the attaching member 54 may take various forms. However, the illustrated presently preferred supporting structure 56, best shown in FIGS. 4, 5 and 10, is of a type generally well known in the art and supports the foldable tablet arm 52 in its operative or working position of FIG. 1 and for movement between the latter position and the collapsed or storage position, shown in FIG. 2, wherein the tablet arm 52 is suspended from the upper rear end of the attaching member at one side of the chair 12 with its working surface 60 disposed within a generally vertical plane and facing laterally outward away from the chair.

Figure 11:
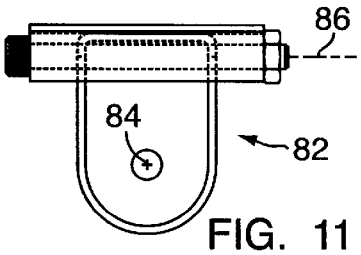
FIG. 11 is a somewhat enlarged side elevational view of the rear pivot hinge.
Figure 13:
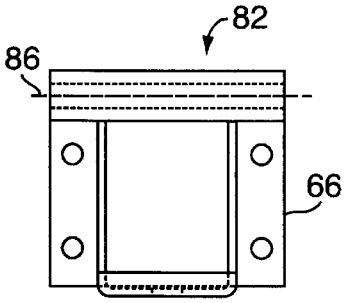
FIG. 13 is a bottom planned of the rear pivot hinge.
Figure 12:
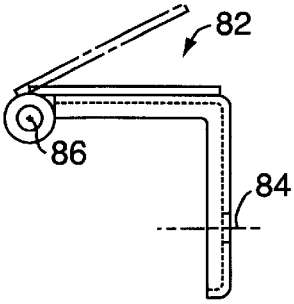
FIG. 12 is a front elevational view of the rear pivot hinge of FIG. 11.

Further considering the illustrated supporting structure 56, the tablet arm 52 is supported at its rear end by a dual pivot hinge indicated generally at 82, for pivotable movement about a fixed generally horizontally extending first axis 84 and for upwardly folding movement from its working position about a second axis 86 extending generally transversely of the direction of extent of the fixed first axis 84 and is shown in some detail in FIGS. 11–13.

Figure 16:
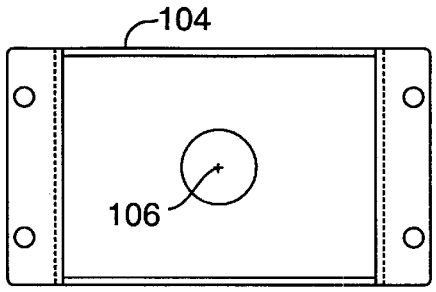
FIG. 16 is bottom plan view of the tablet arm mounting plate.
Figure 15:
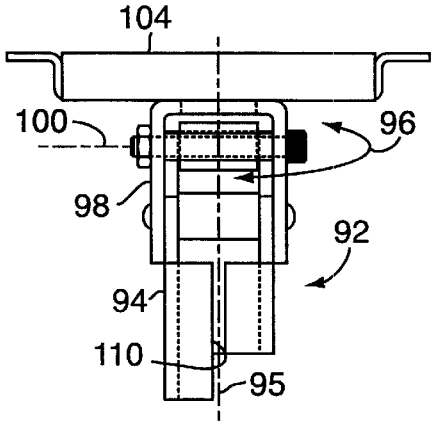
FIG. 15 is a side elevational view of the slide mechanism.
Figure 14:
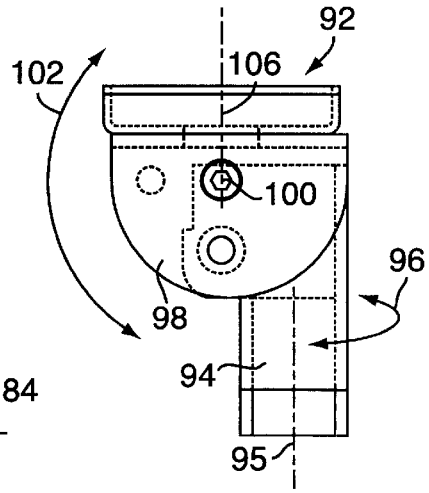
FIG. 14 is a somewhat enlarged front elevational view of the slide mechanism.

The illustrated tablet arm 52 is further supported for compound hinged and pivotal movement between its working and collapsed or storage positions by an axially elongated generally cylindrical support brace or slide tube 88 supported at its lower end for pivotable movement about a horizontally disposed fixed third axis 90 defined by the mounting stud 72 and parallel to the first axis 84. The slide tube 88 is adapted to extend generally vertically upwardly from the lower end of the attaching member 54 to the approximate level of the first horizontally extending fixed axis 84 when the tablet arm 52 is in its operative or working position. Connection between the tablet arm 52 and the slide tube 88 is provided by a slide mechanism, indicated generally at 92 and shown in some detail in FIGS. 14–16. The slide mechanism 92 has a sleeve bracket 94 supported on the slide tube for axially sliding movement there along and for angular movement about a fourth axis 95 defined by the longitude axis of the slide tube 88 and in directions indicated by the directional arrows 96, 96 in FIGS. 5, 14 and 15. A generally U-shaped carrying bracket 98 straddles the sleeve bracket 94 and is supported for tilting movement in one and in opposite direction about a fifth axis 100 spaced from and normal to the direction of axial extent of the tube 88. The carrying bracket 98 is supported for tilting movement about the axis 100 in the directions indicated by the directional arrows 102 in FIG. 14 and carries a tablet arm mounting plate 104 supported for angular movement on and relative to the carrying bracket 98 about a sixth axis 106 which intersects and is normal to the fifth or carrying member axis 100. The tablet arm mounting plate 104 is secured in fixed position to the underside of the tablet arm 52.

Referring to FIG. 1 it will be apparent that the center of gravity of the tablet arm 52 and the carrying bracket axis 100 are located at opposite sides of the slide tube longitudinal axis 95, therefore, the tablet arm 52 tends to remain in its operative position, being supported in the later position by the dual hinge bracket 82 and the slide mechanism 92 and vertically disposed slide tube 88. When the tablet arm is hinged upwardly in a counterclockwise direction from its operative position of FIG. 1, as viewed from in front of the chair, the slide mechanism 92 and more specifically the slide bracket 94 is free to travel along the slide tube 88. Due to the compound pivotable and hinged movements facilitated by the supporting structure 56 the tablet arm 52 is free to travel from its operative position of FIG. 1 to its collapsed or storage position of FIG. 2. An arresting pin 108 mounted in fixed position on the slide tube 88 engages an arresting surface 110 on the slide bracket 94 to limit angular movement of the slide bracket relative to the slide tube when the tablet arm 52 reaches its storage position and retains it in the latter position. Reverse movement of the tablet arm 52 from its storage position places it in its working position of FIG. 1. As previously noted, the supporting mechanism 56 which enables the aforesaid movements of the tablet arm is well known in the art. A further disclosure of a foldable tablet arm supporting structure similar to the one hereinbefore generally described is found in U.S. Pat. No. 3,233,939 to Chapman, issued Feb. 8, 1966 and hereby adopted for reference as part of the present disclosure.

The tablet arm assembly 10 is mounted on an associated chair 12 by first placing the chair in its opened or set-up position of FIGS. 1 and 2. The tablet arm attachment 10, which is preferably in its collapsed condition, is then positioned with the attaching member 54 generally adjacent and in parallel alignment with the chair side member 18 and the male ganging elements or studs 46, 46 in general alignment with the enlarged portions of the female ganging elements or keyslots 58, 58. The fastening tabs 78, 78 may be brought into engagement with associated upper and lower surface portions of the chair side rail 18 before the male studs 46, 46 engage the attaching member 54. Thus, the fastening tabs 78, 78 may be employed to aid in positioning the tablet arm attachment 10 on the chair 12. After the male ganging elements or headed studs 46, 46 carried by the chair 12 enter the female ganging elements 58 or keyslots 58, 58 the attaching member 54 is moved in a downward by inclined direction to position the ganging studs 46, 46 in the upper ends of the keyslots 58, 58, whereupon a condition of coupled engagement is established between the attaching member 54 and the chair 12. This positioning and connecting operation can easily be performed by one person. When coupling engagement has been established the person performing the attaching operation is then free to further releasably secure the fastening plates 78, 78 to the chair side rail 18, 18 with threaded fasteners which completes the tablet arm attaching operation and eliminates any play with might otherwise exist between the two connected structures.

To remove the tablet arm attachment 10 from the chair 12 the tablet arm 52 is preferably first placed in its storage position after which the aforedescribed steps are performed in reverse order.

The present invention has been illustrated and described with reference to a right hand tablet arm attachment. However, it should be evident that a tablet arm attachment of opposite hand may be provided for attachment to the opposite side of a chair by the reversal of parts, as necessary, and such arrangement is contemplated within the scope of the present invention.

I claim:

1. The combination comprising a folding chair and a tablet arm attachment mounted on said folding chair, said folding chair being foldable between seating and storage positions and having a chair frame including a pair of elongated generally rectilinear opposite side members and ganging means including male and female ganging elements associated with said side members for releasably connecting said folding chair in adjacent side-by-side relation to at least one other foldable chair of the same structure and corresponding mateable ganging means when said folding chair is in its seating position, said tablet arm attachment including a tablet arm having a substantially planar working surface, an elongated generally rectilinear attaching member, supporting means for mounting said tablet arm on said attaching member, and releasable attaching means mateable with said ganging means for releasably securing said attaching member to an associated one of said side members and in a predetermined fixed position on and in adjacent generally parallel relation to said associated one of said side members and including a male ganging element carried by one of said members comprising said attaching member and said associated one of said side members and a female ganging element defined by the other of said members comprising said attaching member and said associated one of said side members.

2. The combination as set forth in claim 1 wherein said one of said members comprises said associated one of said side members and said other of said members comprises said attaching member.

3. The combination as set forth in claim 2 wherein said attaching member comprises a tubular member and said female ganging element comprises a keyslot defined by a portion of a sidewall of said tubular member.

4. The combination as set forth in claim 3 wherein said keyslot is defined by a reinforced portion of said sidewall.

5. The combination as set forth in claim 4 wherein said reinforced portion is further characterized as an internally reinforced portion of said sidewall.

6. The combination as set forth in claim 5 wherein said internally reinforced portion includes a reinforcing plate disposed within said attaching member and mounting means for securing said reinforcing plate in fixed position on and within said attaching member in engagement with an inner surface of said sidewall.

7. The combination as set forth in claim 6 wherein said fastening means comprise rivets.

8. The combination as set forth in claim 3 wherein said keyslot comprises a slot extending longitudinally of said elongated attaching member and having a transversely enlarged portion.

9. The combination as set forth in claim 8 wherein said transversely enlarged portion defines an end of said keyslot.

10. The combination as set forth in claim 1 wherein said supporting means is further characterized as means for mounting said tablet arm on said attaching member for pivotal movement between a working position wherein said working surface is in a generally horizontally disposed and upwardly facing position and a storage position wherein said tablet arm is disposed proximate a side of said folding chair and said working surface is disposed in a generally vertical position facing laterally outward and away from said folding chair.

11. The combination as set forth in claim 1 wherein said releasable attaching means includes fastening means for releasable securing said attaching member to said associated one of said side members.

12. The combination as set forth in claim 11 wherein said fastening means includes a first tab carried by said attaching member and overlying a first portion of said associated one of said side members and at least one fastener for releasaby securing said first tab to said associated one of said side members.

13. The combination as set forth in claim 12 wherein said fastening means includes a second tab carried by said attaching member and overlying a second portion of said associated side member spaced from said second portion and at least another fastener for releasably securing said second tab to said associated one of said side members.

14. The combination as set forth in claim 13 wherein said first and second tabs are fastened to said associated one of said side members at opposite sides of a longitudinal axis of said associated one of said side members.

15. A tablet arm attachment for a folding chair having a foldable chair frame including a pair of elongated generally rectilinear side members and ganging means including male and female ganging elements associated with said side members for coupling engagement with mating ganging elements on other chairs of the same structure and corresponding mateable ganging elements, said tablet arm attachment comprising a tablet arm having a substantially planar working surface, an elongated generally rectilinear attaching member, supporting means for mounting said tablet arm on said attaching member, and releasable attaching means adapted to mate with said ganging means of said chair frame for positioning and supporting said tablet arm on and in generally parallel relation to an associated one of said side members and including a male ganging element carried by one of said members comprising said attaching member and said associated one of said side members and a female ganging element carried by the other of said members comprising said attaching member and said associated one of said side members and fastening means for releasably securing said attaching member to said associated one of said side members.

16. A tablet arm attachment as set forth in claim 15 wherein said attaching member comprises said other of said members.

17. A tablet arm attachment as set forth in claim 16 wherein said attaching member comprises a tubular member and said female ganging element comprises a keyslot defined by an internally reinforced portion of said tubular member.

18. A tablet arm attachment as set forth in claim 15 wherein said fastening means includes a tab mounted on said attaching member and overlying an associated portion of said associated one of said side members and a fastener for releasably securing said tab to said associated side member.

19. A tablet arm attachment as set forth in claim 15 wherein said fastening means includes two tabs mounted on said attaching means for overlying associated portions of opposite sides of said associated one of said side members and a plurality of fasteners for releasably securing said tabs to said associated one of said side members.

* * * * *